US006756723B2

(12) United States Patent
Fukushima et al.

(10) Patent No.: US 6,756,723 B2
(45) Date of Patent: Jun. 29, 2004

(54) FLUORESCENT LAMP, METHOD FOR MANUFACTURING THE SAME, AND FLUORESCENT LAMP DEVICE

(75) Inventors: Mamoru Fukushima, Ome (JP); Yasuo Kobayashi, Tokyo (JP); Soichiro Ogawa, Tokyo (JP)

(73) Assignee: Hitachi, Ltd., Tokyo (JP)

( * ) Notice: Subject to any disclaimer, the term of this patent is extended or adjusted under 35 U.S.C. 154(b) by 126 days.

(21) Appl. No.: 10/034,322

(22) Filed: Jan. 3, 2002

(65) Prior Publication Data

US 2002/0053877 A1 May 9, 2002

Related U.S. Application Data

(63) Continuation of application No. 09/123,403, filed on Jul. 28, 1998, now Pat. No. 6,342,763.

(30) Foreign Application Priority Data

Dec. 16, 1997 (JP) ..... 9-346096

(51) Int. Cl.[7] ..... H01J 61/00

(52) U.S. Cl. ..... 313/332; 313/242; 313/240; 313/492; 313/572

(58) Field of Search ..... 313/623, 626, 313/352, 242, 326, 332, 240, 492, 572

(56) References Cited

U.S. PATENT DOCUMENTS 5,298,834 A * 3/1994 Oda et al. ..... 313/622
5,800,047 A 9/1998 Yang

FOREIGN PATENT DOCUMENTS

| | | |
|---|---|---|
| DE | 1539486 | 10/1969 |
| EP | 0491420 | * 6/1992 |
| GB | 0863467 | 3/1961 |
| GB | 0863468 | 3/1961 |
| JP | 52-7174 | 1/1977 |
| JP | 54-44372 | 4/1979 |
| JP | 3-114132 | 5/1991 |
| JP | 4-17252 | 1/1992 |
| JP | 6-140000 | 5/1994 |
| JP | 6-338289 | 6/1994 |
| TW | 318603 | 10/1997 |

* cited by examiner

*Primary Examiner*—Ashok Patel
(74) *Attorney, Agent, or Firm*—Antonelli, Terry, Stout & Kraus, LLP

(57) ABSTRACT

A fluorescent lamp having a stem provided with first and second lead wires for energization of an electrode and an electrically-insulating member provided therein with a first hole and a second hole larger in cross-sectional area than said second lead wire. The first and second lead wires are inserted in the first and second holes of the electrically-insulating member, respectively, and an outer diameter of a glass envelope of the fluorescent lamp is not smaller than 13 mm and not larger than 29 mm.

34 Claims, 22 Drawing Sheets

(a) (b)

FLUORESCENT LAMP, METHOD FOR MANUFACTURING THE SAME, AND FLUORESCENT LAMP DEVICE

This is a continuation of U.S. application Ser. No. 09/123,403, filed Jul. 28, 1998, now U.S. Pat. No. 6,342,763, the subject matter of which is incorporated by reference herein.

BACKGROUND OF THE INVENTION

The present invention relates to a fluorescent lamp, a method for manufacturing the fluorescent lamp and a fluorescent lamp device and preferably, to a fluorescent lamp which can cope with its lamp life end in a high frequency operation. More particularly, the present invention relates to a fluorescent lamp which can suppress melting of stem glass when inner lead wires of a stem are discharged as electrodes and can prevent short-circuiting between the inner lead wires caused by adhesion or deposition of spattering material produced by vaporization of filaments and inner lead wires, a method for manufacturing the fluorescent lamp and a fluorescent lamp device.

When a high frequency power is applied between counter electrodes of a fluorescent lamp to light the lamp, a phenomenon unique to lamp life (the lamp reaches its life end when the lamp has been operated for an accumulated time of several thousands of hours) end takes place. When the lamp comes to the end of the life and emitter material coated on filaments disappears, the lamp usually cannot come on and comes to its life end. However, even when the emitter of the filaments becomes null, there may occur such an unexpected situation that discharge is maintained with the filaments having the emitter already disappeared or inner lead wires being acting as hot spots. In this case, when discharge is maintained with, in particular, the inner lead wires acting as the hot spots, a discharge current larger than its rated value flows through the lead wires. For this reason, the lead wires may melt and eventually its stem may be thermally melted, which operation is called a first operation mode.

Further, in another life end mode of the fluorescent lamp, the material (W) of the filaments, the emitter material (BaO, etc.) coated on the filaments and the material (Ni, Fe) of the inner lead wires spatter and adhere or deposit onto tip end faces of flare stems close to the filaments. In particular, at the end of the lamp life, these substances tend to spatter and adhere or deposit onto the tip end face of each of the flare stems. The above adhesive or deposit, which is electrically conductive, may establish an electric path and energized when deposited. More specifically, the spattered material adhered and deposited on the tip end face of the flare stem may establish an electric path on the surface of the flare stem between a pair of electrically-isolated inner lead wires, thus leading to electric conduction between the inner lead wires. In such a case, a current flows through the electric path to heat the flare stem surface, which disadvantageously results in over-heat damage of the flare stem or in a large wattage loss due to short-circuiting. Such an operation mode is called a second operation mode.

The invention for overcoming the problem with the second operation mode is disclosed in JP-A-6-338289 Publication (referred to as the known citation 1, hereinafter), which will be briefly explained below.

FIGS. 1A to 1C shows an embodiment of a lamp disclosed in the known citation 1, wherein FIG. 1A is a cross-sectional view of the lamp, FIG. 1B is a cross-sectional view of the lamp taken along line A—A in FIG. 1A, and FIG. 1C is a cross-sectional view of the lamp taken along line B—B in FIG. 1A. As shown in FIG. 1B, a recess 202 is made in a flare stem at at least one of root parts of a pair of inner lead wires 201 (The recess is made only at one lead wire in the drawing). In FIG. 1C, reference numeral 203 denotes an exhaust hole of an exhaust tube in the flare stem. Also disclosed in the citation 1 is that the recess may be made in an intermediate part 204 of the flare stem. Such a recess functions as a drop place. With such an arrangement, at the end of the lamp life, substance spattered from the electrode deposits on the flare stem. However, there is such a description in the citation that the presence of the recess functioning as the drop place makes it difficult for the substance to deposit only on that recess area, thus preventing establishment of an electric path and avoiding an electric short-circuiting between the pair of lead wires.

FIG. 2 is an alternate of the arrangement of FIG. 1 disclosed in the citation 1. In the drawing, the same reference numerals as those in FIG. 1 denote the same parts. The arrangement of FIG. 2 is different from that of FIG. 1 in that the recess 202 is replaced by such an insulation tube 205 as to surround the neighborhood of a sealing part of at least one of the inner lead wires 201 (The insulation tube 205 is provided only one lead wire in the drawing). With such an arrangement, the above spattered substance can deposit on the flare stem but less deposit on the inner lead wires 201 in the vicinity of the sealing part, thus blocking formation of the aforementioned electric path.

FIG. 3 shows another alternate of the arrangement of FIG. 1 disclosed in the citation 1. In the drawing, the same reference numerals as those in FIG. 1 denote the same parts as those in FIG. 1. A difference between the arrangement of FIG. 3 and that of FIG. 1 is that the recess 202 in FIG. 1 is replaced by an overhanging member 206 which is provided only for at least one of the pair of inner lead wires 201 (In the illustrated example, the overhanging member 206 is provided only one lead wire). There is such a description in the citation that, with such an arrangement, the aforementioned substance can deposit on the flare stem but the amount of substance deposited onto the inner lead wire 201 in the vicinity of the sealing part can be reduced, thus suppressing formation of the aforementioned electric path.

One of the related citations is JP-A-6-140000 Publication. The citation discloses an arrangement in which, as shown in FIG. 4, a glass bead 101 is fixedly mounted to a pair of lead wires 102. This enables reduction of an oxidizing rate of the lead wires and avoidance of an extremely short life of a fluorescent lamp. With such an arrangement, the presence of the glass bead 101 enables reduction of the amount of deposit spattered onto the lead wires 102 and onto an area 110 on the flare stem. However, since the above spattered deposit substance deposits on the glass bead 101, a short-circuiting may disadvantageously take place between the pair of lead wires through the deposit on the glass bead 101. In the drawing, reference numeral 105 denotes a bead mount, numeral 106 denotes a filament coil, 105 denotes a bead mount, 109 denotes an exhaust tube.

One of the related citations is JP-A-3-81950 Publication. The citation describes the aforementioned first operation mode. As an arrangement of overcoming the problem with the first operation mode, an arrangement of FIG. 23 is disclosed therein. FIG. 23 shows an arrangement in the vicinity of a lamp electrode. A button stem 27 is air-tightly joined to an end of a glass bulb 21 by means of an adhesive agent (not shown). Provided to the button stem 27 is a support rod 29, on which a heat shielding plate 30 is mounted. The heat shielding plate 30, which is disposed between an electrode 26 and stem 27, is made of heat-resistive metal such as stainless material. The heat shielding plate 30, which is shaped into a trough, covers a rear side of the electrode 26. Numerals 28*a* and 28*b* denote lead wires respectively. Such a description is disclosed in the citation that, with such an arrangement, even if the above first operation mode phenomenon takes place, the possibility of over-heat damage of the button stem 27 can be reduced because of the heat shield.

One of the related citations is JP-A-54-44372 Publication. The citation is directed to an improvement in an interior 2 of a fluorescent lamp 1, in which, as shown in FIG. 24, a circular heat shielding plate 13 is provided between a filament 12 and a base 9 to use the base 9 as a coolest point and to prevent heat radiated from the filament 12 from transmitting to the base 9. In this case, reference numeral 14 denotes lead wires, and numeral 15 denotes supporting members for supporting the heat shielding plate 13. This arrangement is intended to avoid deterioration of its good-looking lamp as a product caused by blackening of phosphor coated on a glass tube in the vicinity of the filament. To this end, the base 9 is set to have the coolest point to thereby suppress such blackening. With this arrangement, the shield is provided between the lead wire 14 and a stem 16, which is expected to suppress deposition of the above spattered substance onto the stem 16. However, this arrangement has a problem that, since the heat shielding plate 13 is fixed to the lead wire 14 without any substantial gap therebetween, the above spattered substance deposits on the heat shielding plate, thus disabling prevention of short-circuiting between the pair of lead wires 14.

SUMMARY OF THE INVENTION

The inventors of the present application have examined the fluorescent lamp disclosed in the above citation fluorescent lamp 1 and found several problems that the lamp cannot exhibit sufficient effects of reducing generation of the above first and second operation modes and cannot be easily manufactured on a mass production basis, etc.

(Problem with the First Operation Mode)

A problem common to the arrangements of FIGS. 1 to 3 is that no consideration is paid to avoiding the first operation mode in these arrangements. The first operation mode takes place for either one of the pair of lead wires, but in these arrangements, it is not clear that the first operation mode occurs in which lead wire. In order to properly cope with the first operation mode, it is necessary, even if the first operation mode takes place for either lead wire, to arrange the lamp in such a manner as to be able to cope with it. However, the citation fluorescent lamp 1 refers only to the fact that the recess, insulation tube and overhanging member are provided only for at least one of the lead wires in pair and fails to refer to the fact that they should be provided for both of the lead wires as its indispensable conditions. Such an arrangement cannot sufficiently cope with the first operation mode.

(Problems with the Second Operation Mode)

(1) With the arrangement of FIG. 1, since the creeping distance of the electric path is longer than that in the prior art, the probability of short-circuit occurrence is reduced to some extent. However, it is not necessarily sufficient and the electric path is established and short-circuited at a certain frequency. That is, as a result of examinations by the present inventors, it has been found that the second operation mode sometimes takes place.

(2) With the arrangement of FIG. 3, further, the overhanging member 206 is provided to the inner lead wire 201, which however is basically of a cantilever beam structure. Thus, as will be seen from FIG. 3, the substance deposits on the flare stem by going from the surrounding of the overhanging member, and the amount of such deposit becomes unneglibible. In other words, there cannot avoid eventual establishment of an electric path between the pair of lead wires.

(Other Problems)

(1) The arrangement of FIG. 2, there is described in the citation 1 that the insulation tube 205 may be made of ceramic, quartz or ordinary glass. In the case of using ceramic, however, the material of the flare stem is glass and thus a difference in thermal expansion coefficient between the ceramic and glass becomes large. Such a manufacturing step is employed that the lead wires are inserted into insulation tubes and then sealed with the flare stem of the glass material. In this case, because of the large difference in thermal expansion coefficient between the both materials, after the flare stem has sealed the insulation tubes, spontaneous cooling thereof involves a problem that the flare stem of glass is cracked. Further, when the insulation tube is made of glass, another problem is that the arrangement cannot sufficiently cope with the first operation mode. This is because generation of the first operation mode causes the lead wires to be heated, which disadvantageously melts the insulation tubes. In addition, even employment of any of the above materials inevitably involves complicated manufacturing steps.

(2) With the arrangement of FIG. 3, there is a description in the citation 1 that the overhanging member 206 may be made of ceramic, quartz, ordinary glass or metal. This arrangement requires the overhanging member 206 to be properly fixed to the lead wire. Otherwise, the overhanging member will be rotated about the lead wire and further moved along the lead wire, thus leading to deterioration of the original function of the member. In order to fix the both, further, some stoppers are necessary. The necessary number of such stoppers is 2 or 4. When the member is provided to one of the lead wires in pair, the total number of such stoppers is 2 because the electrode is provided at each of both ends of the discharge lamp. When the overhanging member is provided to each of the lead wires in pair, the number of such stoppers is 4 that is twice the above case. This involves a problem that member mounting works become troublesome and its manufacturing steps become complicated. An additional problem is that, when the overhanging member is made of glass material, the lamp cannot sufficiently cope with the first operation mode. This is because occurrence of the first operation mode causes heating of the lead wires to melt the member, with the result that the member eventually drops off from the wires.

It is therefore an object of the present invention to provide a fluorescent lamp which can overcome the above problems in the prior art, and also to provide a method for manufacturing the lamp.

The above object is attained by providing a fluorescent lamp employing any one of two first and second arrangements (1) and (2) which follow.

(1) First Arrangement

In a fluorescent lamp wherein a light emitting envelope is air-tightly sealed at each end with glass sealing material including a glass stem and a pair of first and second metallic lead wires, and a filament is provided to one ends of the pair of inner lead wires located inside the envelope; an insulator is provided between the filament and a top of the stem so that the first and second inner lead wires are passed through the stem and insulator, and the insulator covers boundary areas on the stem corresponding to the both lead wires or covers the entire top of the stem. In this case, the insulator is provided therein with first and second holes, into which the above lead wires in pair are inserted. A cross-sectional area of the holes is set to be larger than a cross-sectional area of the first and second lead wires. A value obtained by dividing the hole sectional area by the sectional area of the first and second lead wires is set to be not smaller than 1.2 and not larger than 10. Or a value obtained by dividing the diameter of the holes by the diameter of the first and second lead wires may be set to be not smaller than 1.1 and not larger than 3.3.

In this arrangement, there also be provided a fluorescent lamp which comprises a stem having the first and second lead wires for energization of an electrode and an electrically-insulating member provided therein with first and second holes, and wherein the first and second lead wires are inserted in the first and second holes so that a gap is defined between a boundary part of the first hole and the first lead wire in the vicinity of a contact part of the first hole with the first lead wire.

(2) Second Arrangement

In a fluorescent lamp which comprises a stem provided with first and second lead wires for energization of an electrode and electrically-insulating first and second members of a tubular shape having the first and second lead wires inserted therein, and wherein a cross-sectional area of the hollow part of the first and second members is larger than a cross-sectional area of the first and second lead wires. In this connection, a value obtained by dividing the cross-sectional area of the hollow part of the first and second members by the cross-sectional area of the first and second lead wires is set to be not smaller than 1.2 and not larger than 10. A value obtained by dividing a diameter of the hollow part of the first and second members by a diameter of the first and second lead wires may be set to be not smaller than 1.1 and not larger than 3.3.

In the first arrangement, since insulator is provided around the first and second lead wires, even when the first operation mode took place, advancement of abnormal discharge can be suppressed. Our experiments have showed that, when the first operation mode took place in a fluorescent lamp not having such an insulator, discharge causes lead wires to melt down to a flare stem level; whereas, when the first operation mode took place in a fluorescent lamp having such an insulator, the provision of the insulator enables such discharge to be suppressed or stopped. More specifically, it has been confirmed that the discharge was stopped with the lead wires remained on their filament side of the insulator.

With the arrangement, further, since the insulator is provided so as to cover the sealing boundary areas of the glass stem with the lead wires or to cover the entire head area of the stem, spattering of substance from the filament onto the flare stem or sealing areas can be more sufficiently suppressed than the prior art and thus a probability of generating the second operation mode can be reduced. Furthermore, since the insulator is provided therein with first and second holes or is structured as mentioned above, even the substance deposits on the insulator, the deposit will not lead to formation of a short-circuited path between the pair of lead wires. This is because gaps defined between the holes and lead wires act to block the formation of the short-circuited path.

Even in the second arrangement, since the first and second members are provided around the first and second lead wires, even when the first operation mode took place in either lead wire, the advancement of abnormal discharge can be suppressed. When the size of the hollow part of these members is selected sufficiently large when compared with the size or diameter of the lead wires, it has been confirmed that the provision of these members makes it difficult to maintain the above abnormal discharge. It has also been confirmed that, even when the discharge advances from the tip ends of the lead wires toward the flare stem, the provision of the members makes it difficult to maintain the discharge and the discharge stops short of reaching the members. It has also been confirmed that the absence of such members exhibits no such effect.

Further, since these tubular members cover the sealing areas and have an inner diameter sufficiently large when compared with the diameter of the lead wires, formation of a short-circuited path between the lead wires can be blocked.

The second arrangement is featured in that the first and second members having the hollow part sufficiently larger than the cross-sectional area of the lead wires are employed by design. This enables sufficient reduction of a short-circuit probability between the lead wires. Even with the arrangement of FIG. 2, it seems (not disclosed) that the inner diameter of the tube is slightly larger than the diameter of the lead wires, but a difference therebetween is such small as enough to tightly fit the both.

DESCRIPTION OF THE PREFERRED EMBODIMENTS

Embodiments of the present invention will be explained with reference to the accompanying drawings.

(Embodiment 1)

Figure 1A:
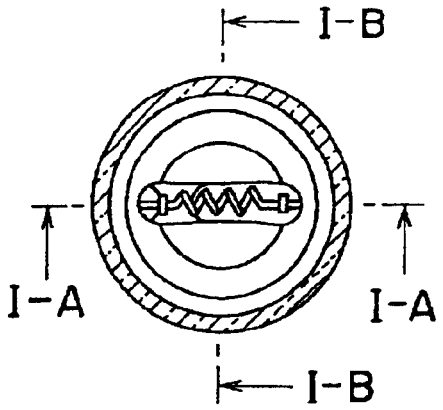
FIG. 1A PRIOR ART
FIGS. 1A to 1C show a flare stem and its vicinity of a prior art fluorescent lamp, with the flare stem having a recess formed therein.
Figure 1B:
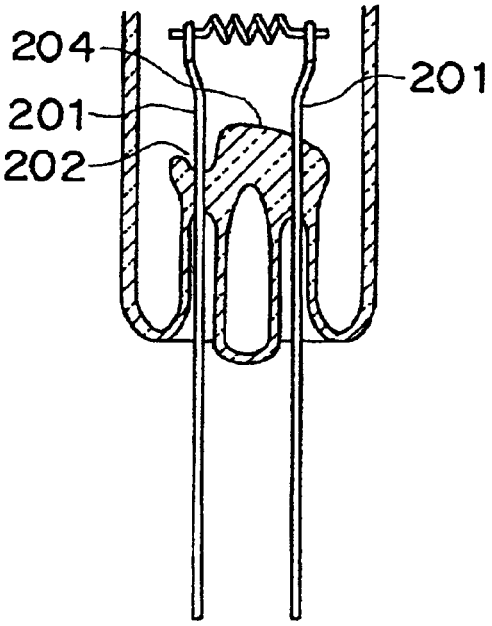
Figure 1C:
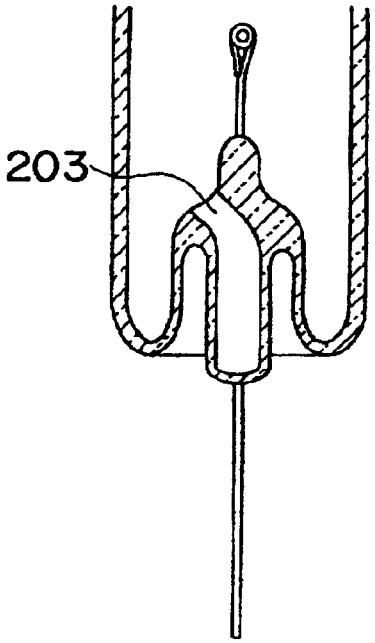
Figure 2A:
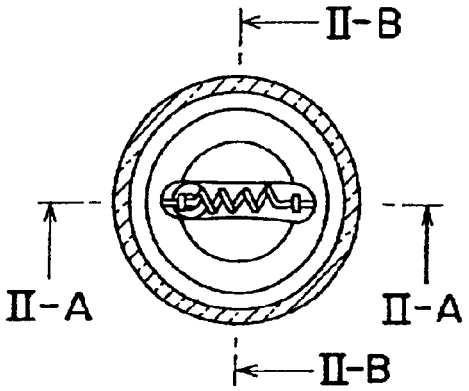
FIG. 2A PRIOR ART
FIGS. 2A to 2C show a flare stem and its vicinity of another prior art fluorescent lamp, with the flare stem having lead wires inserted into insulation tubes.
Figure 2B:
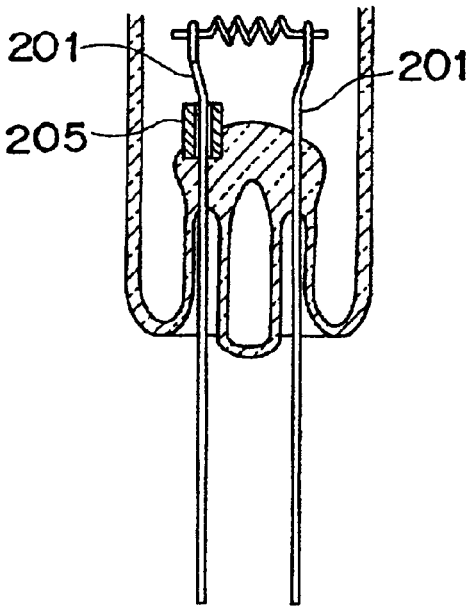
Figure 2C:
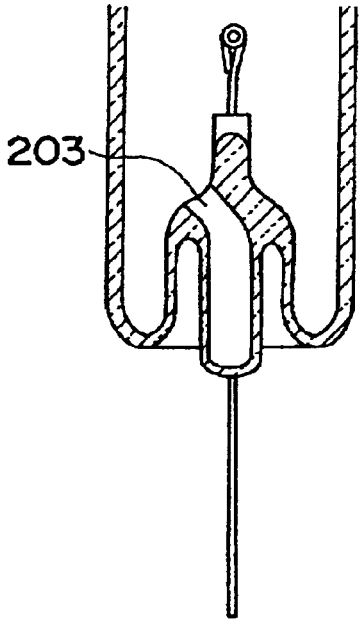
Figure 3A:
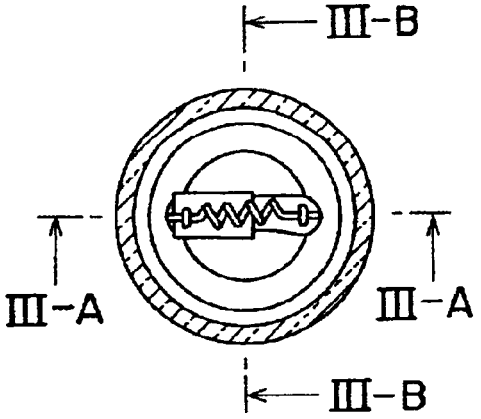
FIG. 3A PRIOR ART
FIGS. 3A to 3C show a flare stem and its vicinity of a further prior art fluorescent lamp, with the flare stem having an overhanging member provided to one lead wire.
Figure 3B:
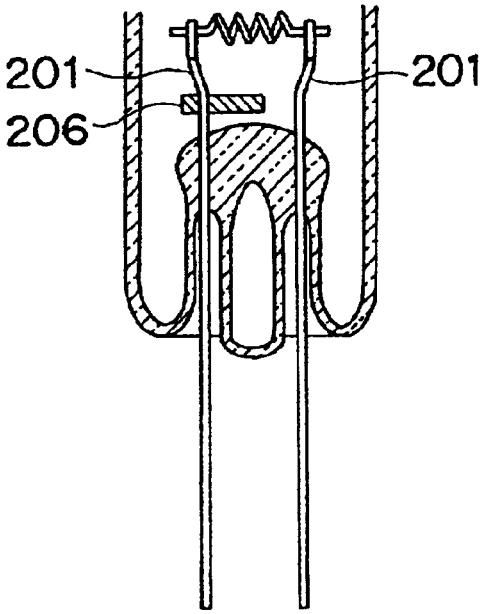
Figure 3C:
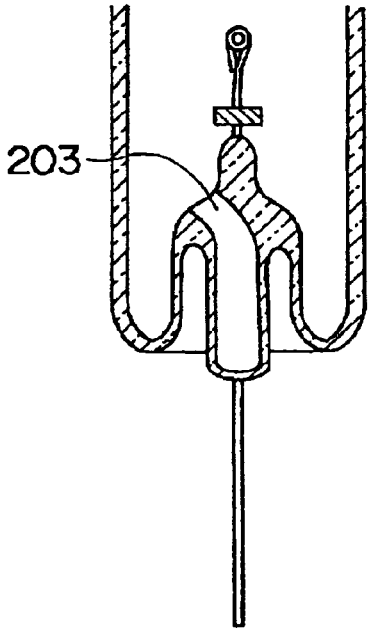
Figure 4:
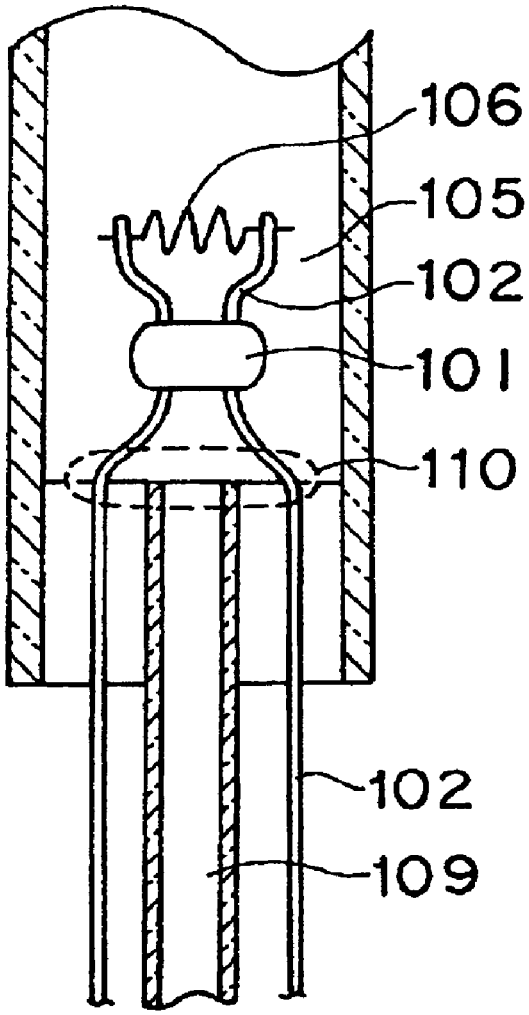
FIG. 4 PRIOR ART
FIG. 4 shows a part of yet a further fluorescent lamp of a structure having lead wires bundled with a glass rod.
Figure 5A:
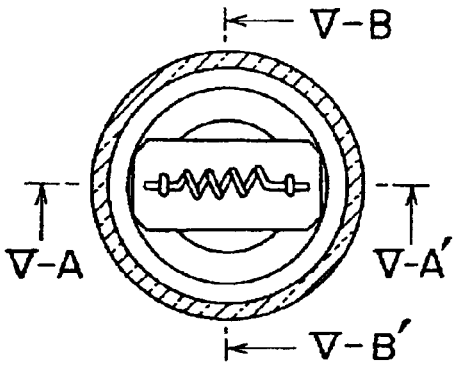
FIGS. 5A to 5C show a fluorescent lamp in accordance with a first embodiment of the present invention, in which lead wires are inserted into a ceramic plate and held therein.
Figure 5B:
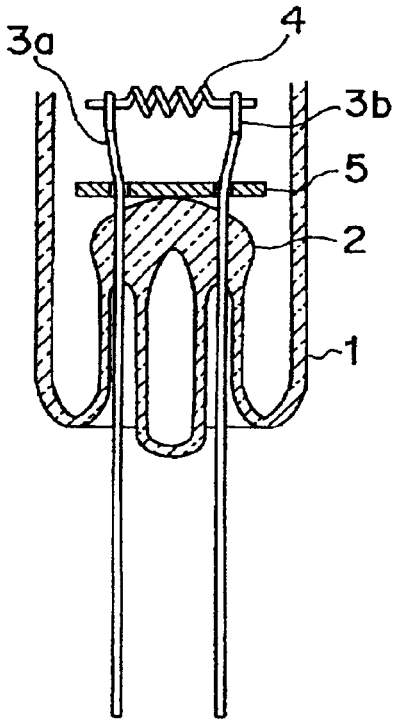
Figure 5C:
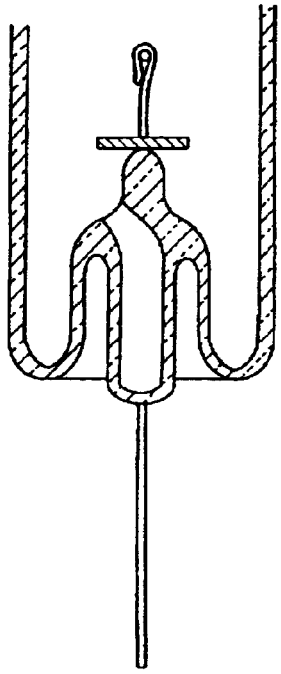
Figure 6:
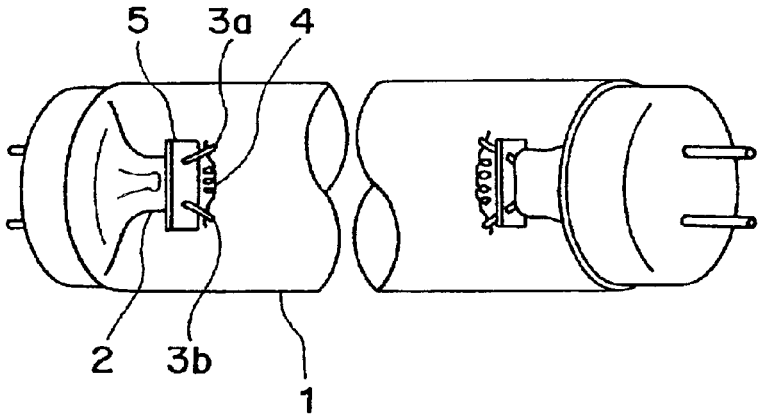
FIG. 6 shows an entire fluorescent lamp having a stem in FIG. 5 in the first embodiment of the present invention.

FIG. 5A shows a cross-sectional view of one of ends (having stems for holding respective electrodes) of a fluorescent lamp in accordance with a first embodiment of the present invention, FIG. 5B shows a cross-sectional view of the same taken along line A—A in FIG. 5A, and FIG. 5C shows a cross-sectional view of the same taken along line B—B in FIG. 5A. FIG. 6 is a perspective view of an entire straight fluorescent lamp having such an electrode structure as shown in FIG. 5 in the present embodiment. In the drawing, a light emitting envelope 1 as a glass tube is formed on its inside wall with a phosphor film. The light emitting envelope 1 is closed at its ends by respective flare stems 2 so that the interior of the envelope is sealed against outside the envelope. Passed through the flare stem 2 air-tightly are a pair of inner lead wires 3*a* and 3*b* each made of a nickel coated iron wire having a diameter of 0.6 mm. The inner lead wires 3*a* and 3*b* are provided at their one ends with a filament 4 made of tungsten. Coated on the filament 4 is emitter substance such as barium oxide.

Provided to the flare stem 2 is an insulator (ceramic plate in this illustrated example) 5 which is formed therein with two holes of 1 mm in diameter so as to cover an area of the stem between sealed parts of the pair of inner lead wires 3*a* and 3*b*. The insulator 5 is loosely mounted on the stem so that, as the insulator goes toward the filament, a distance between the lead wires becomes larger.

Figure 7A:
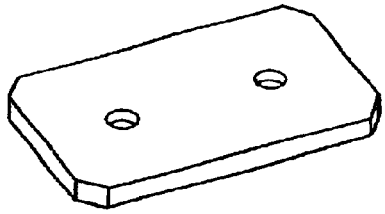
FIGS. 7A and 7B show the ceramic plate used in the arrangement of FIG. 5 in the first embodiment of the present invention.
Figure 7B:
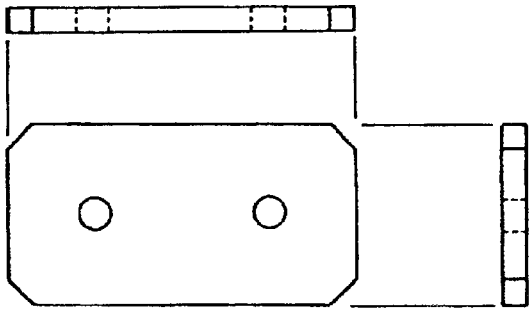
Figure 8:
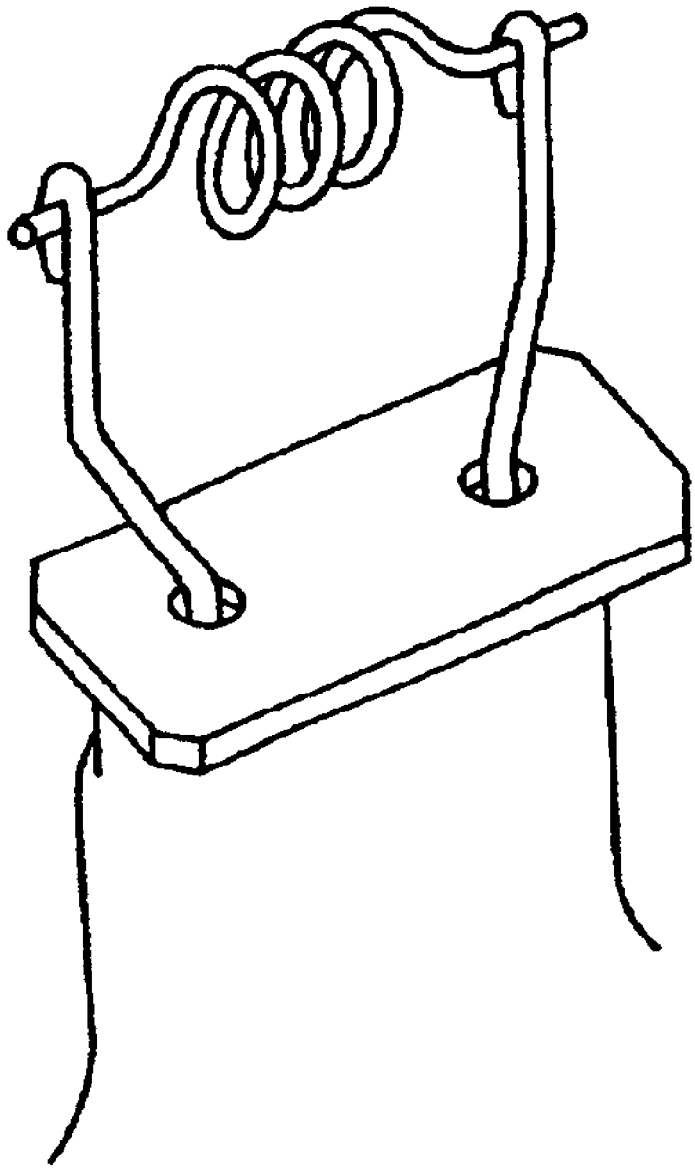
FIG. 8 is a perspective view of a flare stem part having a pair of lead wires inserted into the ceramic plate in the first embodiment of the present invention.

The insulator 5 as a ceramic plate was made to have a nearly rectangular shape having a vertical dimension of 7 mm, a horizontal dimension of 14 mm and a thickness of 1 mm, and made of alumina ceramic. FIG. 7A is a perspective view of the ceramic plate, and FIG. 7B shows views as viewed from 3 sides of the plate. FIG. 8 shows a perspective view of a flare stem part having the pair of lead wires inserted into the ceramic plate.

Figure 9:
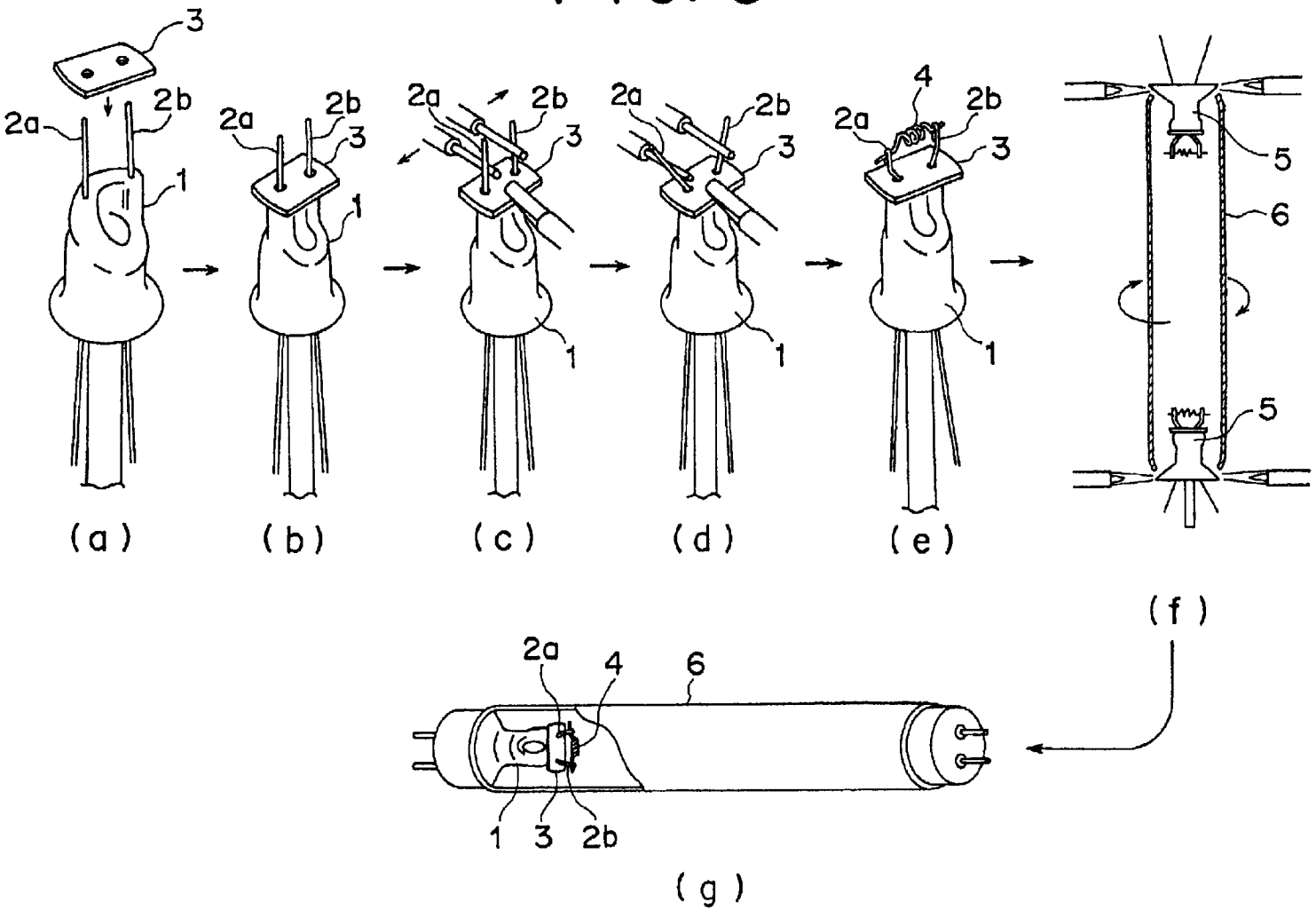
FIG. 9 shows steps of manufacturing the fluorescent lamp shown in FIG. 6 in the first embodiment of the present invention.

FIG. 9 shows steps of manufacturing a fluorescent lamp using the ceramic plate. As shown in FIG. 9(*a*), a stem 1 has a pair of inner lead wires 2*a* and 2*b*. The pair of inner lead wires 2*a* and 2*b* are made substantially straight and passed through a ceramic or insulating plate 3 (refer to FIG. 9(*a*)). After passed through the insulating plate, the pair of intermediate lead wires are bent (refer to FIGS. 9(*c*) and 9(*d*)). This bending enables limitation of the movement of the ceramic plate along the intermediate lead wires. Then an electrode (filament) 4 is fixed to the lead wires (refer to FIG. 9(*e*)), thus forming a stem mount 5. The stem mounts 5 prepared in this way are sealed inside a glass envelope 6 at both ends thereof, the envelope being coated on its inside wall with phosphor (refer to FIG. 9(*f*)). At this time, the glass envelope is provided at its one end with an exhaust tube for discharging air inside the glass envelope. At the same time when the glass tube is vacuumed through the exhaust tube, a current is supplied to the electrode to activate carbonate such as barium carbonate coated on the electrode, a suitable amount of inactive gas is sealingly charged into the tube, a suitable amount of mercury is charged thereinto, and then the exhaust tube is cut and sealingly closed to thereby complete a fluorescent lamp (refer to FIG. 9(*g*)).

The lamp having such a structure was lighted as combined with a high frequency lighting ballast (high frequency lighting circuit) to confirm failure modes (that is, the aforementioned first and second operation modes) of the lamp at the end of its life. The confirmation was conducted through tests by coating the same amount of coat as its mass-production design value on one of the lamp electrodes and coating an excessively small amount of emitter substance on the other electrode to shorten a life end reproduction time. Further, for the purpose of observing the vicinities of the electrodes, such a glass envelope 6 was employed that the phosphor film on the inside wall of the envelope is not formed near the electrodes.

Our experiments have showed that, even when the filament was broken, discharge was maintained and further that, even when the inner lead wires were changed to an electrode (hot spot) and started melting, the melting stopped at the position of the insulator and did not reach such a situation that the stem glass melted. This means that the first operation mode took place but it was able to be stopped. Further, it has also been observed that substance spattered from the filament was adhered and deposited on the insulator, but it has been confirmed that supply of a current to the lead wires did not lead to a stem melt mode. This means that the ceramic plate performed a function of blocking the second operation mode.

For reconfirmation, a prior art fluorescent lamp having substance already spattered from filaments and deposited on the tops of the stems at the end of its life was subjected to measurement of a resistance between the pair of lead wires. The resistance was as very small as 50 to 200 Ω.

The lamp of the present embodiment, on the other hand, was subjected to similar measurement of a resistance. The resistance was substantially infinity. Thus it has been confirmed that the embodiment lamp can exhibit a sufficient effect of preventing the second operation mode. This is considered to be because the insulator is mounted as not fully fixed to the lead wires but as moved somewhat, so that the ceramic plate is partially contacted with the lead wires, that is, in a point contact relationship therebetween. For this reason, it is considered that establishment of an electric path is blocked. In other words, it can be considered that a gap between the ceramic plate and lead wires contributes to avoidance of the establishment of the electric path. On the contrary, when the ceramic plate is fully fixed to the lead wires, this may result in that an electric path is highly possibly established between the pair of lead wires.

Although the insulator has been made of alumina ceramic in the present embodiment, it can be made of, in addition to it, any material such as forsterite ($2MgO.SiO_2$), steatite ($MgO.SiO_2$) or jircon ($ZrO_2.SiO_2$)), so long as it is insulating ceramic. The insulator further may be made of heat-resistive glass such as quartz glass or hard glass or made of mica. In other words, the insulator may be made of any material so long as it is highly resistive to heat, stable, produces no impurity gas in vacuum, and more preferably, if it is excellent in processability.

Although the diameter of the wire hole has been made to be 1 mm in the present embodiment, the cross-sectional area of the hole is basically required to be only larger than the cross-sectional area of the inner lead wire. When consideration is paid even to needs of mountability of the wires to the stem on a mass production basis, avoidance of too large play of the insulator after the lamp bulb is completed, and avoidance of generation of a little strange sound resulting from the too large play, however, the sectional area of the hole is preferably in a range of 1.2 to 10 times the sectional area of the inner lead wire. When the hole and lead wire are both circular in their cross-sectional shape, a ratio between the wire and hole in the cross-sectional area is preferably 1.1 to 3.3 (which holds true for cases which follow). When the ratio is smaller than the above value, the mountability becomes worse. When the ratio is larger than the above value, the ceramic plate produces a little strange sound, disadvantageously degrading its product value. Further, when the cross-sectional area of the hole becomes too large, it is impossible to sufficiently block deposition of substance spattered to the vicinity of the lead wires, thus disabling sufficient suppression of the second operation mode.

In this connection, a pitch between the two holes may be set to be nearly equal to a pitch between the lead wires. Though the hole shape has been made circular in the present embodiment, it goes without saying that any other shape may be employed with substantially the same effects as in the above case.

Further, although the shape of the insulator has been made rectangular in the present embodiment, any shape may be employed so long as it can cover the entire head part of the stem. For example, the insulator shape may be made not plate-like but simply block-like.

Figure 20A:
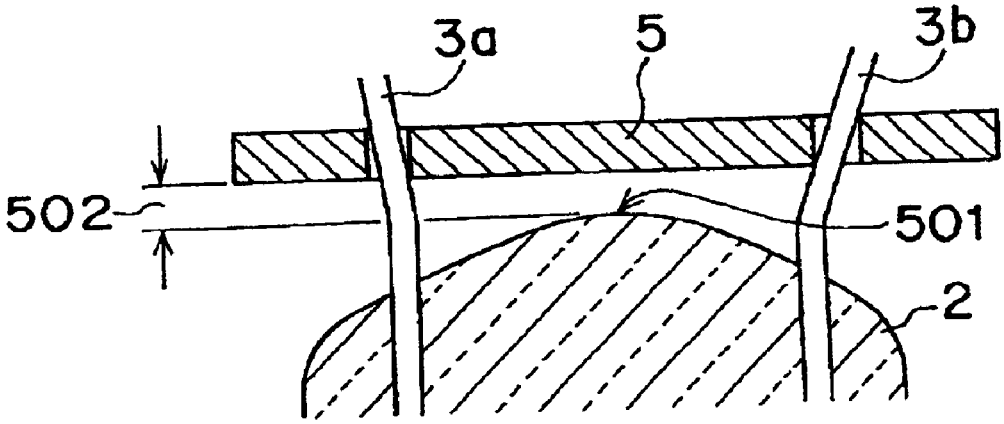
FIGS. 20A and 20B are diagrams for explaining a gap dimension between a top of the flare stem and an insulator provided to the lead wires in the second embodiment of the present invention.
Figure 20B:
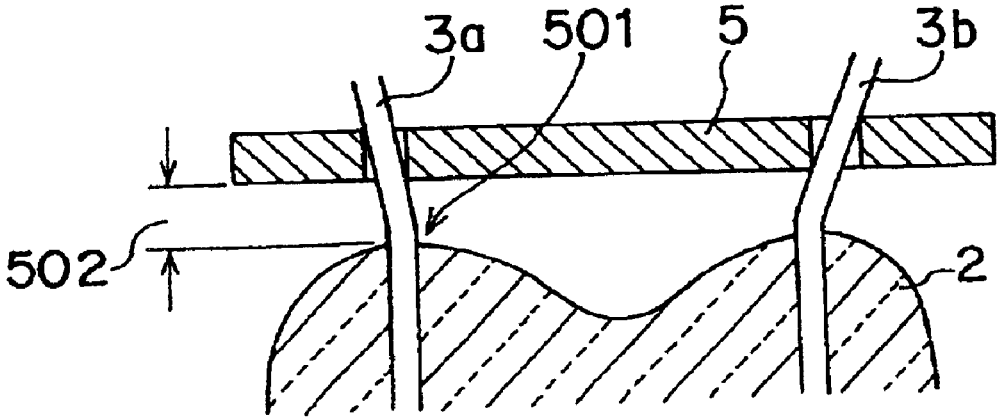

Explanation will then be made as to a spacing between the insulator provided to the lead wires and the flare stem. FIGS. 20A and 20B are diagrams for explaining the spacing. In FIG. 20A, a spacing 502 between a top 501 of the flare stem 2 upwardly projected and the insulator 5 provided to lead wires 3*a* and 3*b* is set to be desirably not smaller than 0 mm and not larger than 5 mm. As shown in FIG. 20B, the spacing 502 between the top 501 of the flare stem 2 upwardly recessed and the insulator 5 provided to the lead wires 3*a* and 3*b* is set to be desirably not smaller than 0 mm and not larger than 5 mm. The flare stem can have one of various sorts of shapes but the top of the flare stem and the insulator should be set to be desirably not smaller than 0 mm and not larger than 5 mm. In this case, the spacing of 0 mm means that the top 501 of the flare stem 2 comes into contact with the insulator 5 provided to the lead wires 3*a* and 3*b*.

Figure 10A:
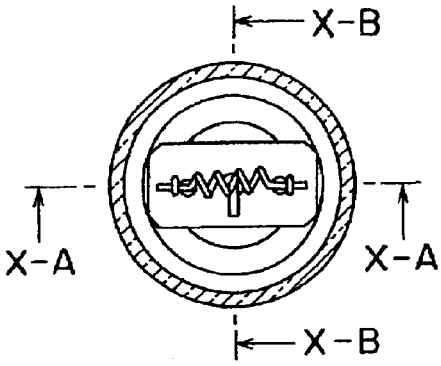
FIGS. 10A to 10C show another method for fixing a ceramic plate by inserting lead wires and an intermediate lead wire into the ceramic plate and bending the intermediate lead wire in the first embodiment of the present invention.
Figure 10B:
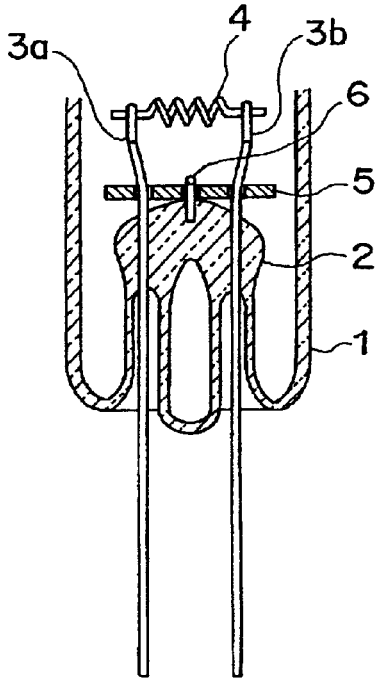
Figure 10C:
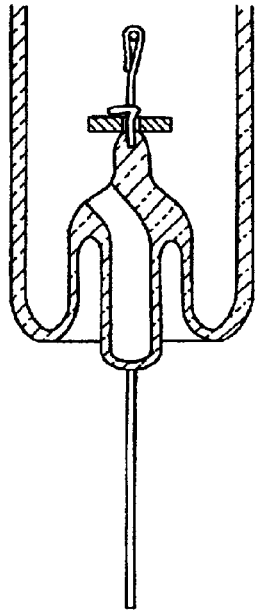

Shown in FIG. 10 is another method for fixing the insulator 5 in the present embodiment. In the drawing, the insulator 5 is provided therein with three holes which have a cross sectional area of 1.2 to 10 times as large as the cross-sectional area of the pair of inner lead wires 3*a* and 3*b*.

Figure 11:
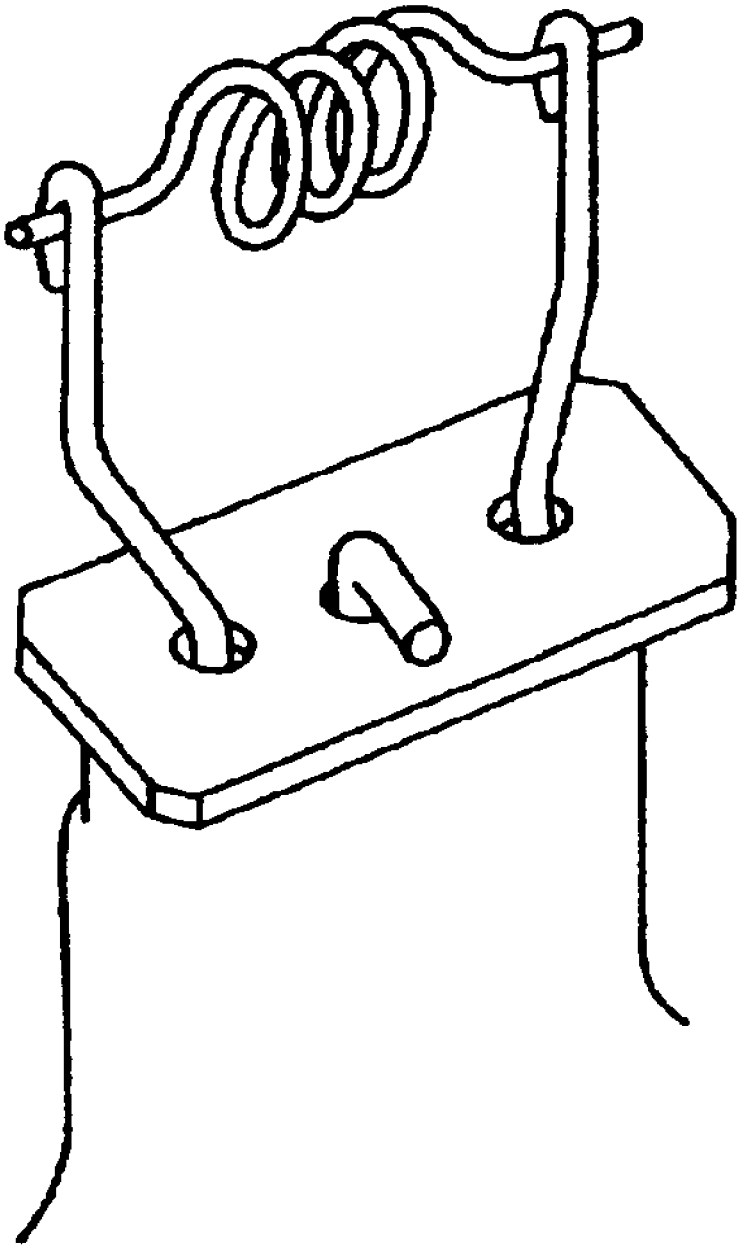
FIG. 11 is a perspective view of a flare stem part which has a pair of lead wires inserted into a ceramic plate and which is fixed by the intermediate lead wire, in the first embodiment of the present invention.

Inserted into these holes and passed therethrough are the inner lead wires 3*a* and 3*b* as well as an intermediate lead wire 6 in the stem between the pair of intermediate lead wires. Further, the intermediate lead wire 6 is bent to thereby hold the insulator 5. FIG. 11 shows its perspective view.

In this fixing method, even when the first operation mode takes place and the lead wires 3*a* and 3*b* melted and detached, the insulator is still fixed by means of the intermediate lead wire 6, thus avoiding the detachment of the insulator. Therefore, even when the lead wires 3*a* and 3*b* are detached, generation of the second operation mode can be suppressed.

Figure 12:
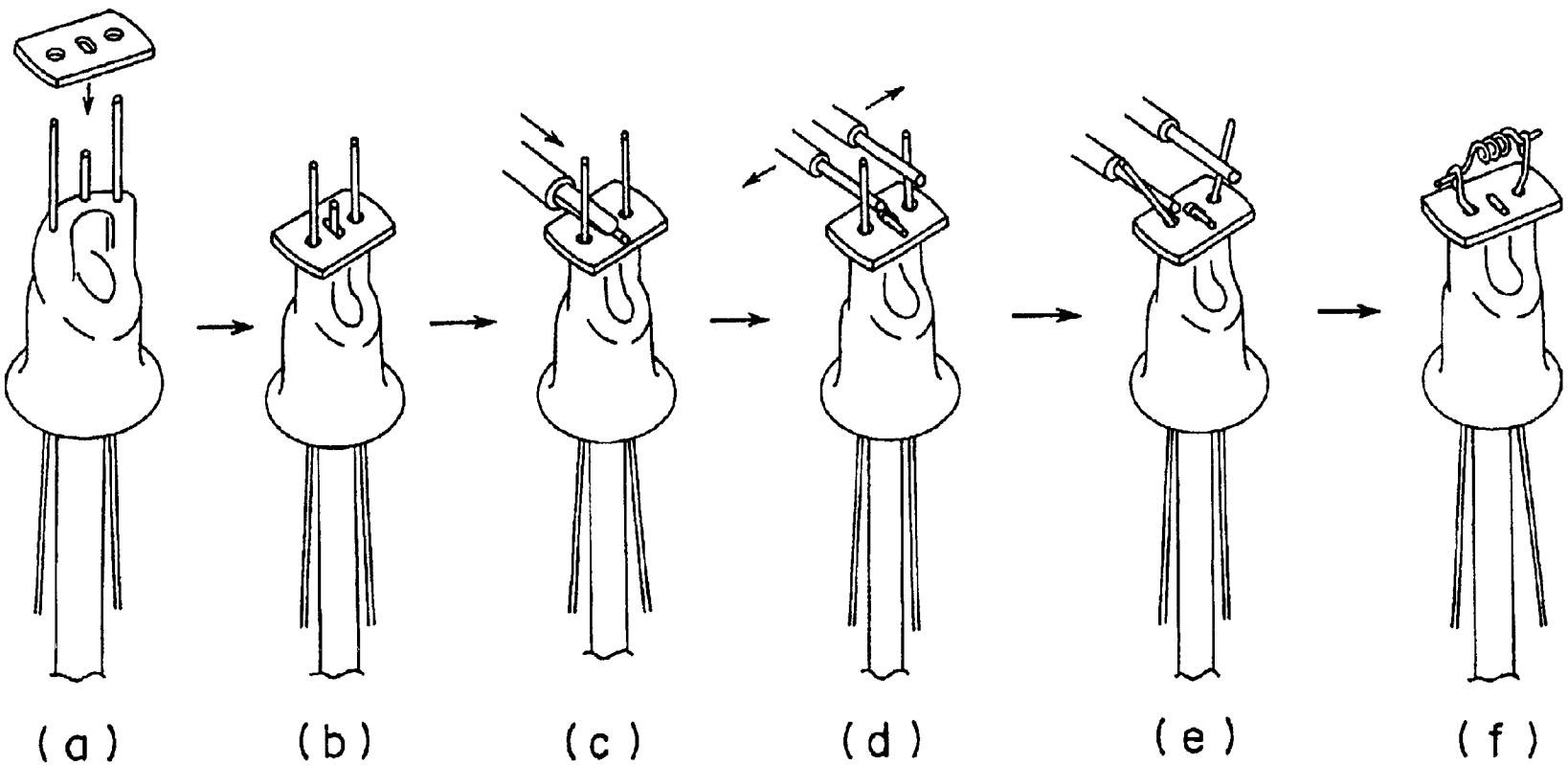
FIG. 12 shows steps of manufacturing the flare stem shown in FIG. 11 in the first embodiment of the present invention.

FIG. 12 shows steps of manufacturing a fluorescent lamp having such a structure as mentioned above. FIGS. 12(*a*) to 12(*f*) correspond to FIGS. 9(*a*) to 9(*f*). The steps of FIG. 12 are substantially the same as those of FIG. 9, except that a step is newly added for inserting the intermediate lead wire 6 into the associated hole and bending the wire.

Figure 13A:
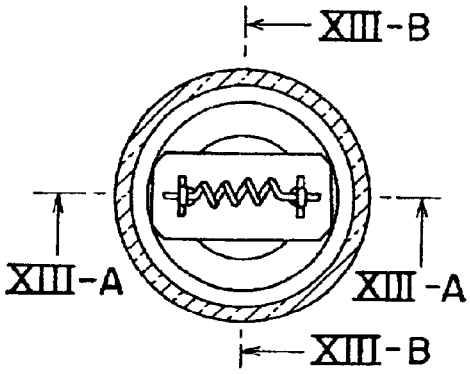
FIGS. 13A to 13C show a further method for fixing a ceramic plate by inserting lead wires into the ceramic plate and fixing the lead wires by means of stoppers in the first embodiment of the present invention.
Figure 13B:
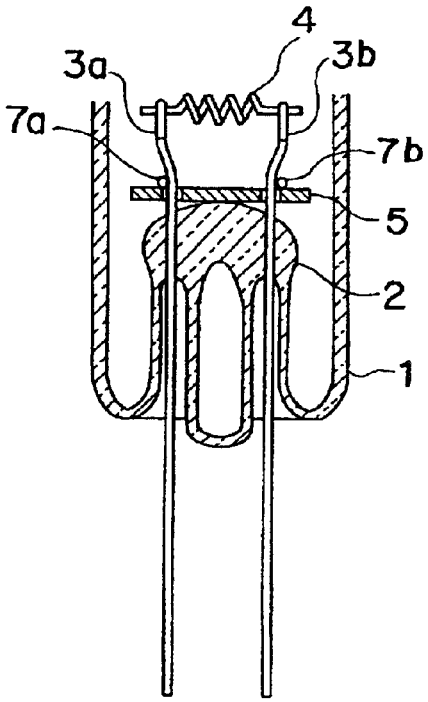
Figure 13C:
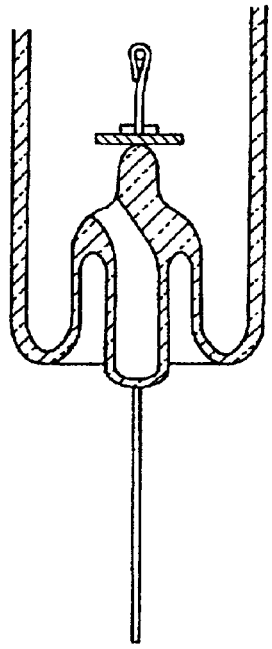

FIGS. 13A to 13C show a further method for fixing the insulator 5 in the present embodiment. As shown in FIG. 13B, the insulator 5 is provided therein with two holes which have a sectional area of 1.2 to 10 times as large as the sectional area of the pair of inner lead wires 3*a* and 3*b*. The pair of inner lead wires 3*a* and 3*b* are inserted into the two holes and the insulator 5 is held by stoppers 7*a* and 7*b* provided at halfway of the inner lead wires 3*a* and 3*b*. The stoppers 7*a* and 7*b* are each made of a metal wire and fixed to the lead wires by welding.

Although the metal wires have been used as the stoppers by welding in this example, any material other than the metal wires can be employed without any limitation, so long as it can restrict the movement of the insulator.

Figure 14:
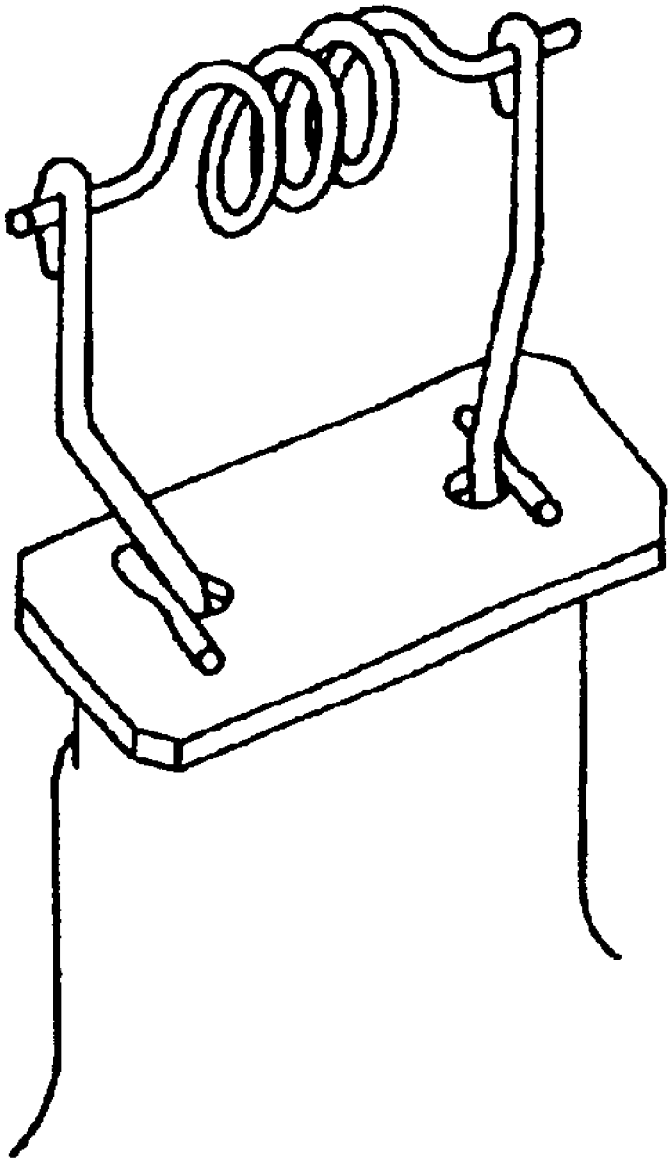
FIG. 14 is a perspective view of a flare stem part provided with the ceramic plate having the pair of lead wires inserted thereinto and fixed by the stoppers in the first embodiment of the present invention.

FIG. 14 is a perspective view of a flare stem part of the lamp shown in FIG. 13.

Although the explanation has been made in connection with the flare stem as sealing member which is most commonly used in the fluorescent lamp in the embodiment of the present invention, another sealing member using glass such as a button stem or a pinch seal may be employed to provide substantially the same effects as the above.

Figure 15:
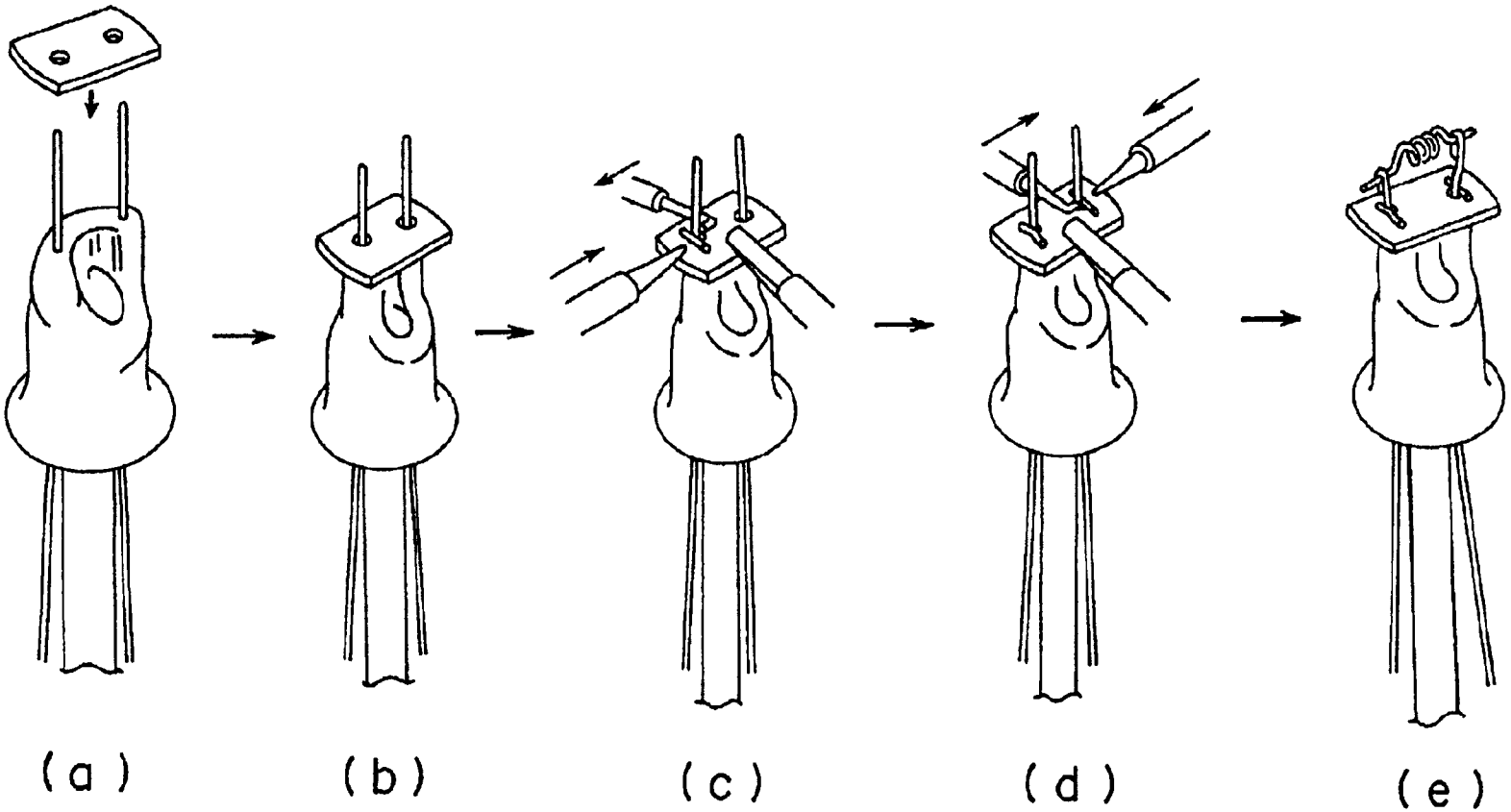
FIG. 15 shows steps of manufacturing the flare stem in FIG. 14 in the first embodiment of the present invention.

FIG. 15 shows steps of manufacturing a fluorescent lamp having such a structure as mentioned above, in which FIGS. 15(*a*) to 15(*e*) correspond to FIGS. 9(*a*) to 9(*e*). The steps of FIGS. 15(*a*) to 15(*e*) are substantially the same as those of FIGS. 9(*a*) to 9(*f*), except that a step of fixing the stoppers is newly added.

(Embodiment 2)

FIGS. 16 to 19 are diagrams for explaining a second embodiment of the present invention.

Figure 16A:
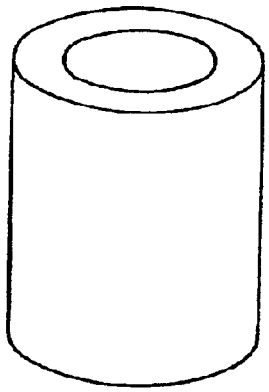
FIGS. 16A and 16B show a perspective view of an insulation tube and 3 views thereof as viewed from its 3 sides in a second embodiment of the present invention.
Figure 16B:
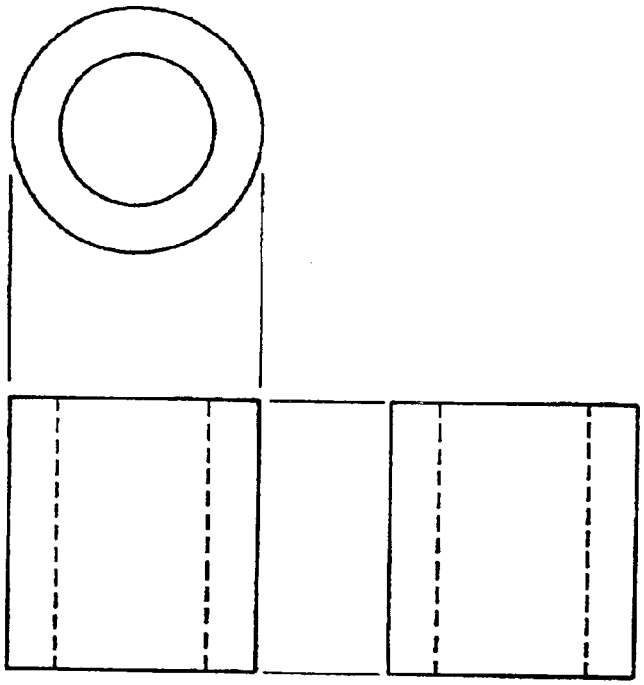
Figure 17:
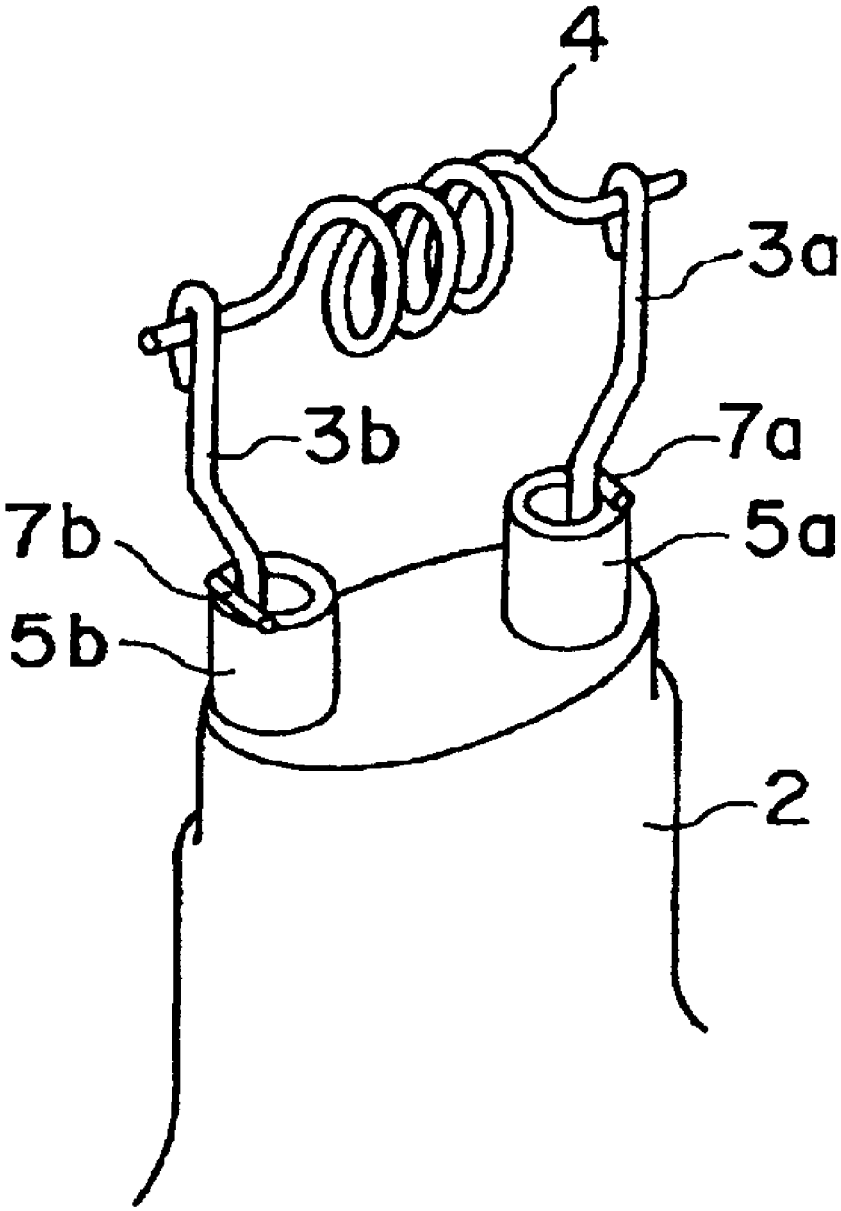
FIG. 17 is a perspective view of a flare stem having the insulation tubes of FIG. 16 in the second embodiment of the present invention.
Figure 18A:
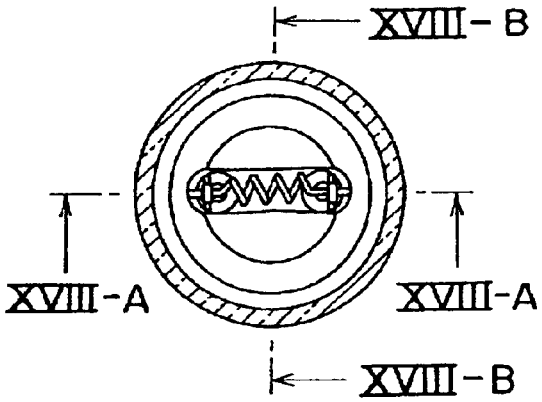
FIGS. 18A to 18C show a view for fixing lead wires by inserting the lead wires into insulation tubes and holding the tubes by means of stoppers in the second embodiment of the present invention.
Figure 18B:
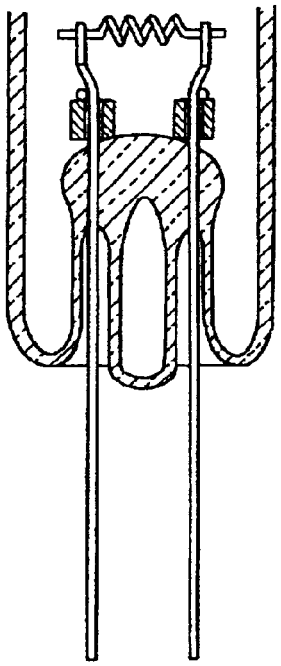
Figure 18C:
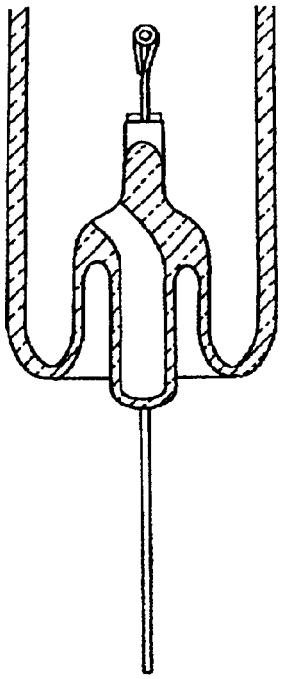

In the present embodiment, in place of the insulator such as the ceramic plate, a tubular electrical insulator (which will also be sometimes referred to as the insulation tube, hereinafter) is used. FIG. 16A is a perspective view of the insulation tube, and FIG. 16B shows three views as viewed from three sides thereof. In the present embodiment, each of the lead wires is inserted into each of the insulation tubes, which in turn are fixed by means of respective stoppers. FIG. 17 shows its perspective view, and FIG. 18 shows three views of a fluorescent lamp having the stem of FIG. 17. FIG. 18A shows a cross-sectional view of an end (including the step for holding the electrode) of the fluorescent lamp, FIG. 18B is a cross-sectional view thereof taken along line A—A in FIG. 18A, and FIG. 18C is a cross-sectional view thereof taken along line B—B in FIG. 18A.

As shown in FIG. 17, a filament 4 is provided at one ends of a pair of lead wires 3*a* and 3*b* having a diameter of 0.6 mm provided in the flare stem 2. The filament 4 is coated with emitter substance such as barium oxide.

Mounted in and on the flare stem 2 are the pair of inner lead wires 3*a* and 3*b* as well as insulators 5*a* and 5*b* covering respective interface sealing parts of the stem with the lead wires. In the illustrated example, the insulator was made in the form of a hollow cylinder having an inner diameter of 1 mm, an outer diameter of 4 mm and a height of 7 mm. These insulators 5*a* and 5*b* are loosely mounted by means of the stoppers 7*a* and 7*b* made of nickel wires at halfway of the respective lead wires.

Figure 19:
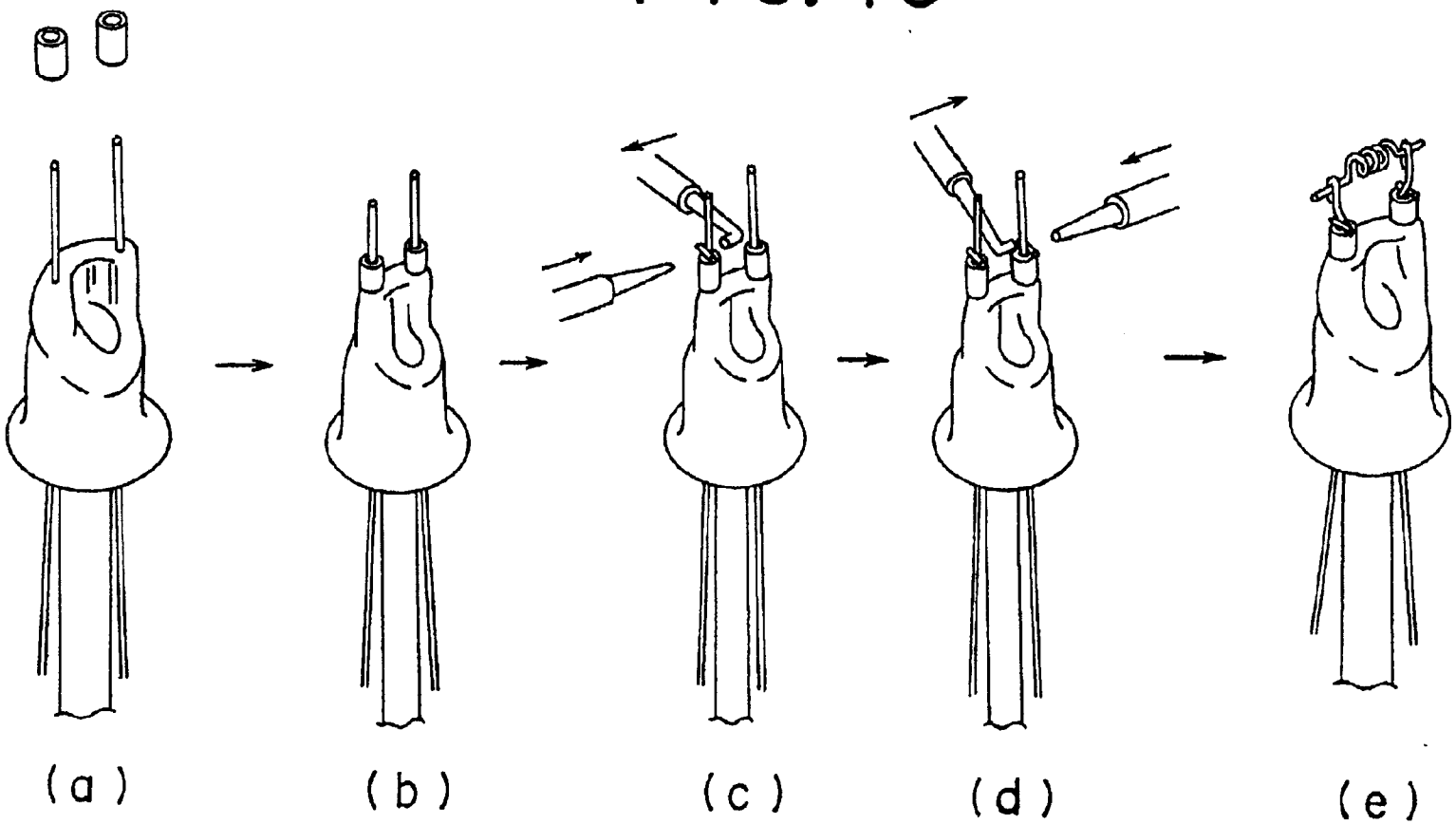
FIG. 19 shows steps of manufacturing the flare stem of FIG. 17 in the second embodiment of the present invention.

FIG. 19 shows steps of manufacturing a fluorescent lamp having such a structure as mentioned above. FIGS. 19(*a*) to 19(*e*) correspond to FIGS. 9(*a*) to 9(*e*). The steps of FIGS. 19(*a*) to 19(*e*) are substantially the same as those of FIGS. 9(*a*) to 9(*f*), except that the fixing step is replaced by a step of inserting the insulation tubes and fixing the tubes by respective stoppers.

When the lamp having such a structure as mentioned above is combined with the high frequency lighting ballast (high frequency lighting circuit) explained in the first embodiment and then lighted to confirm the life end failure mode, it has been confirmed that the stem will not melt even in either mode of the first and second operation modes.

In the first mode, after the filament was broken, discharge was maintained with one lead wire, the lead wire was melted, and the discharge stopped when the melting of the lead wire reached the insulator, without stem melting.

Since the insulators function to prevent the substance spattered from the electrode from being adhered to or deposited on the interface sealing parts of the stem with the pair of lead wires, the second operation mode did not take place. As a result of measuring a resistance between the both lead wires, it has been confirmed that the resistance was substantially infinity.

In this system, however, in the case where the hollow part is too large in diameter when compared with the diameter of the lead wire, it is considered that, when the lead wire was melted, the stopper may also be melted, whereby the insulator may be dismounted. To avoid this, the sectional area of the hollow is optimumly in a range of 1.2 to 4 times the sectional area of the lead wire, and preferably in a range of 1.2 to 10 times.

Although the insulator has been made cylindrical in the present embodiment, any other ceramic plate 3-dimensional shape may be employed so long as it can cover the interface sealing parts of the stem with the lead wires.

(Embodiment 3)

A third embodiment of the present invention can be suitably applied to a discharge lamp including a glass envelope having an outer diameter of not smaller than 13 mm and not larger than 29 mm. The envelope has a wall thickness of about 0.6 mm to 0.7 mm.

Figure 25:
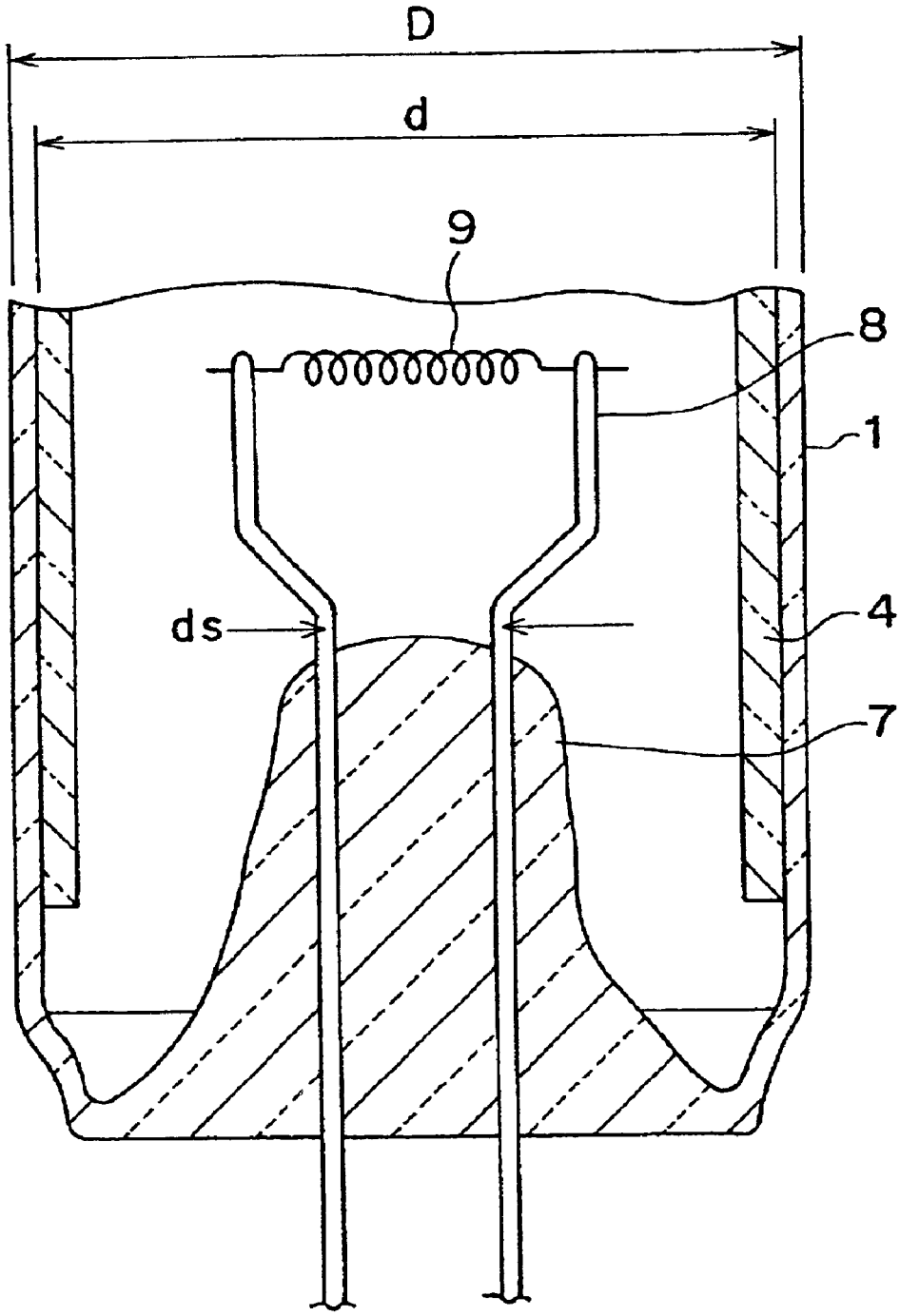
FIG. 25 shows a structure of an electrode part and its vicinity of a lamp in accordance with a third embodiment of the present invention.

The above will be explained in connection with FIG. 25. A glass envelope 1 is coated on its inner wall with phosphor 4. An electrode 9 is fixedly mounted to a pair of lead wires 8. The glass envelope has an outer diameter D and an inner diameter d. The size of a stem 7 and the magnitude of a spacing $d_s$ between the lead wires at the tip end of the stem depend on the magnitude of the inner diameter of the glass envelope. The inventors of the present application have found that, when the spacing $d_s$ between the lead wires is in a certain range, generation of the second operation mode can be avoided. When the spacing is narrowed to some extent, the creeping distance on the stem between the lead wires in pair becomes short. This tends to cause a short-circuiting, thus generating the second operation mode. It has been found that lamps using glass envelopes having outer diameters of not smaller than 5 mm and not larger than 33 mm and using stems with lead wires tend to easily cause the second operation mode. Thus, in the case of such lamps, it is especially preferable to provide such a member as shown in FIG. 7 or FIG. 16 between the electrode and stem, though not illustrated in FIG. 25.

(Embodiment 4)

The lamp having such a structure as shown in Embodiments 1 to 3, when combined with a known fluorescent lamp lighting circuit, can form a fluorescent lamp device.

Figure 21:
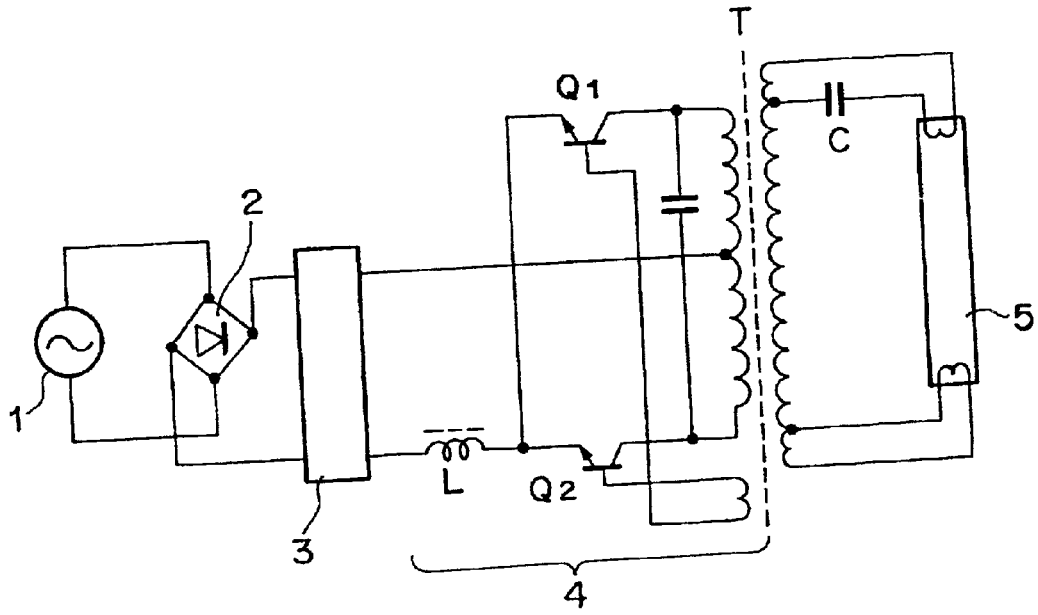
FIG. 21 PRIOR ART
FIG. 21 is an exemplary lighting circuit of a prior art fluorescent lamp.

An example of the fluorescent lamp lighting circuit is shown in FIG. 21. In the drawing, reference numeral 1 denotes an A.C. power source, numeral 2 denotes a rectifier circuit, 3 denotes a smoothing circuit, 4 denotes a high frequency inverter lighting circuit, and 5 denotes a fluorescent lamp.

Figure 22:
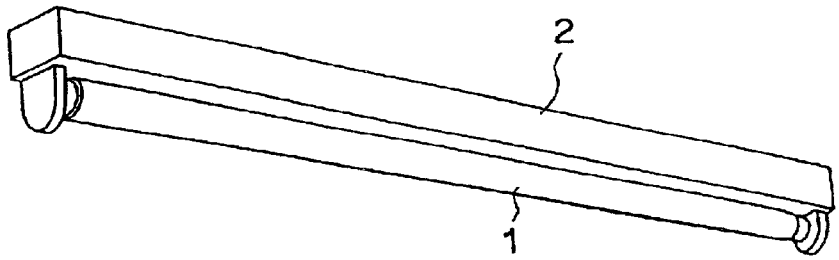
FIG. 22 shows an appearance of a fluorescent lamp device corresponding to a combination of a fluorescent lamp and a lighting fixture.
Figure 23A:
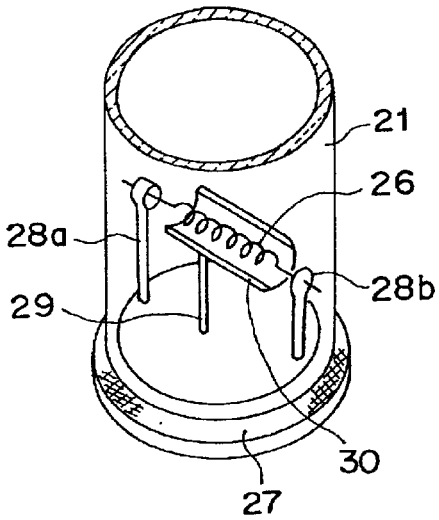
FIG. 23A PRIOR ART
FIGS. 23A, 23B and 24 show a structure of an electrode part and its vicinity of a prior art fluorescent lamp.
Figure 23B:
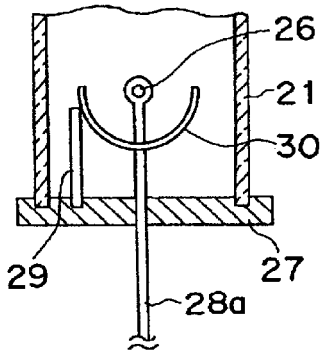
Figure 24:
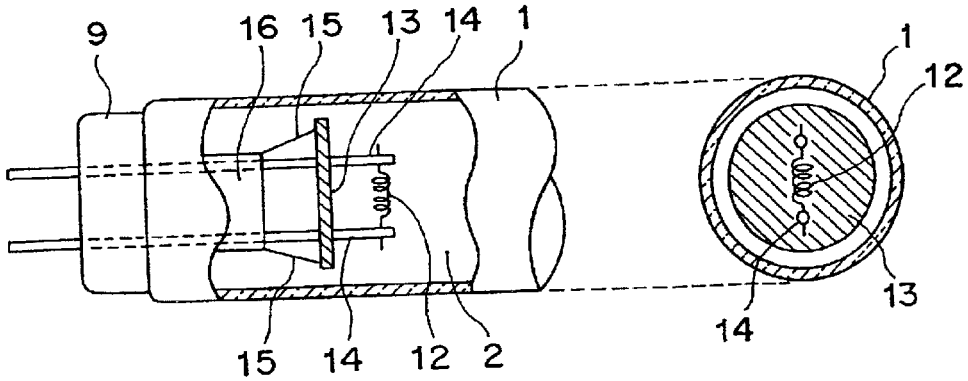
FIG. 24 PRIOR ART

FIG. 22 shows an appearance of a fluorescent lamp device comprising a combination of the fluorescent lamp 1 in accordance with the embodiment of the present invention and a lighting fixture 2 incorporating such a lighting circuit as shown in FIG. 21.

As has been explained in the foregoing, in accordance with the foregoing embodiments of the present invention, the earlier-mentioned problems can be suppressed or minimized.

What is claimed is:

1. A fluorescent lamp comprising:

a stem provided with first and second lead wires for energization of an electrode; and an electrically-insulating member having a first hole and a second hole larger in cross-sectional area than said second lead wire;

wherein said first and second lead wires are inserted in said first and second holes of said electrically-insulating member, respectively; and wherein an outer diameter of a glass envelope of the fluorescent lamp is not smaller than 13 mm and not larger than 29 mm.

2. A fluorescent lamp as set forth in claim 1, wherein said electrically-insulating member reduces a possibility that substance spattered from said electrode deposits on a surface of said stem and on said first and second lead wires to form a deposit as part of an electric path which short-circuits said first and second lead wires.

3. A fluorescent lamp as set forth in claim 1, wherein said electrically-insulating member functions, when discharge takes place with said first and second lead wires as hot spots, to suppress the discharge from being maintained.

4. A fluorescent lamp as set forth in claim 1, wherein said electrically-insulating member is held to said first and second lead wires by means of a holding member.

5. A fluorescent lamp as set forth in claim 1, wherein said electrically-insulating member is a plate-like member and is made of one of an insulating ceramic, quartz glass and mica.

6. A fluorescent lamp comprising:

a stem provided with first and second lead wires for energization of an electrode; and an electrically-insulating member having a first hole and a second hole larger in cross-sectional area than said second lead wire;

wherein said first and second lead wires are inserted in said first and second holes of said electrically-insulating member, respectively, and then bent in directions so as to increase the spacing between said first and second lead wires at parts of said first and second lead wires which are extended from said stem and which are located on sides of tips thereof from said electrically-insulating member; and wherein an outer diameter of a glass envelope of said fluorescent lamp is not smaller than 13 mm and not larger than 29 mm.

7. A fluorescent lamp as set forth in claim 6, wherein said electrically-insulating member reduces a possibility that substance spattered from said electrode deposits on a surface of said stem and on said first and second lead wires to form a deposit as part of an electric path which short-circuits said first and second lead wires.

8. A fluorescent lamp as set forth in claim 6, wherein said electrically-insulating member functions, when discharge takes place with said first and second lead wires as hot spots, to suppress the discharge from being maintained.

9. A fluorescent lamp as set forth in claim 6, wherein said electrically-insulating member is held to said first and second lead wires by means of a holding member.

10. A fluorescent lamp as set forth in claim 6, wherein said electrically-insulating member is a plate-like member and is made of one of an insulating ceramic, quartz glass and mica.

11. A fluorescent lamp device wherein a fluorescent lamp is high-frequency lighted, comprising:

a fluorescent lamp including:

a stem provided with first and second lead wires for energization of an electrode; and an electrically-insulating member having a first hole and a second hole larger in cross-sectional area than said second lead wire;

said first and second lead wires being inserted in said first and second holes of said electrically-insulating member, respectively;

wherein an outer diameter of a glass envelope of said fluorescent lamp is not smaller than 13 mm and not larger than 29 mm; and wherein a high-frequency lighting circuit is provided for lighting said fluorescent lamp.

12. A fluorescent lamp device as set forth in claim 11, wherein said electrically-insulating member reduces a possibility that substance spattered from said electrode deposits on a surface of said stem and on said first and second lead wires to form a deposit as part of an electric path which short-circuits said first and second lead wires.

13. A fluorescent lamp device as set forth in claim 11, wherein said electrically-insulating member functions, when discharge takes place with said first and second lead wires as hot spots, to suppress the discharge from being maintained.

14. A fluorescent lamp device as set forth in claim 11, wherein said electrically-insulating member is held to said first and second lead wires by means of a holding member.

15. A fluorescent lamp device as set forth in claim 11, wherein said electrically-insulating member is a plate-like member and is made of one of an insulating ceramic, quartz glass and mica.

16. A fluorescent lamp device wherein a fluorescent lamp is high-frequency lighted, comprising:

a fluorescent lamp including:

a stem provided with first and second lead wires for energization of an electrode; and an electrically-insulating member having a first hole and a second hole larger in cross-sectional area than said second lead wire;

said first and second lead wires being inserted in said first and second holes of said electrically-insulating member, respectively;

wherein a spacing between a top of said stem and said member being not smaller than 0 mm and not larger than 5 mm; and wherein a high-frequency lighting circuit is provided for lighting said fluorescent lamp.

17. A fluorescent lamp comprising an envelope, a stem provided with a pair of lead wires for energization of an electrode, and an electrically-insulating member disposed between said electrode and said stem and having a pair of holes through which said lead wires extend, wherein a cross-sectional area of said holes is larger than a cross-sectional area of said lead wires so as to leave a gap between a boundary of a respective hole and a respective lead wire extended therethrough.

18. A fluorescent lamp according to claim 17, wherein one of a ratio of the cross-sectional area of the respective hole divided by the cross-sectional area of the respective lead wire is not smaller than 1.2 and not larger than 10, and a ratio of a diameter of the respective hole divided by a diameter of the respective lead wire is not smaller than 1.1 and not larger than 3.3.

19. A fluorescent lamp according to claim 17, wherein said pair of wires are bent so as to increase in spacing therebetween as said pair of lead wires extend away from said electrically-insulating member.

20. A fluorescent lamp according to claim 17, wherein said electrically-insulating member is fixed to said stem by a wire engaging a hole provided in said electrically-insulating member which is intermediate said pair of holes.

21. A fluorescent lamp according to claim 17, wherein said electrically-insulating member is held to said lead wires by means of stopper members fixed to said lead wires.

22. A fluorescent lamp according to claim 17, wherein said electrically-insulating member is plate-like and made of at least one of ceramic, quartz glass and mica.

23. A fluorescent lamp according to claim 17, wherein a spacing between a top of said stem and said electrically-insulating member is not larger than 5 mm.

24. A fluorescent lamp according to claim 17, wherein said envelope has an outer diameter not smaller than 5 mm and not larger than 33 mm.

25. A fluorescent lamp according to claim 24, wherein said envelope has an outer diameter not smaller than 13 mm and not larger than 29 mm.

26. A fluorescent lamp device comprising said fluorescent lamp according to claim 17, and a high-frequency circuit for lighting said fluorescent lamp.

27. A fluorescent lamp according to claim 18, wherein said pair of wires are bent so as to increase in spacing therebetween as said pair of lead wires extend away from said electrically-insulating member.

28. A fluorescent lamp according to claim 18, wherein said electrically-insulating member is fixed to said stem by a wire engaging a hole provided in said electrically-insulating member which is intermediate said pair of holes.

29. A fluorescent lamp according to claim 18, wherein said electrically-insulating member is held to said lead wires by means of stopper members fixed to said lead wires.

30. A fluorescent lamp according to claim 18, wherein said electrically-insulating member is plate-like and made of at least one of ceramic, quartz glass and mica.

31. A fluorescent lamp according to claim 18, wherein a spacing between a top of said stem and said electrically-insulating member is not larger than 5 mm.

32. A fluorescent lamp according to claim 18, wherein said envelope has an outer diameter not smaller than 5 mm and not larger than 33 mm.

33. A fluorescent lamp according to claim 32, wherein said envelope has an outer diameter not smaller than 13 mm and not larger than 29 mm.

34. A fluorescent lamp device comprising the fluorescent lamp according to claim 18, and a high-frequency circuit for lighting said fluorescent lamp.

* * * * *

UNITED STATES PATENT AND TRADEMARK OFFICE

CERTIFICATE OF CORRECTION

PATENT NO. : 6,756,723 B2
DATED : June 29, 2004
INVENTOR(S) : Fukushima et al.

It is certified that error appears in the above-identified patent and that said Letters Patent is hereby corrected as shown below:

Title page,
Item [*] Notice, should read
-- [*] Notice: Subject to any disclaimer, the term of this patent is extended or adjusted under 35 U.S.C. 154(b) by 126 days.

This patent is subject to a terminal disclaimer. --

Signed and Sealed this

Twenty-sixth Day of April, 2005

JON W. DUDAS
*Director of the United States Patent and Trademark Office*